United States Patent [19]

Riedel

[11] 4,030,320

[45] June 21, 1977

[54] DECATIZING OF FABRICS

[75] Inventor: Dieter Riedel, Turmblick, Germany

[73] Assignee: Drabert Sohne, Minden, Germany

[22] Filed: Feb. 19, 1976

[21] Appl. No.: 659,536

[30] Foreign Application Priority Data

July 5, 1975 Germany ..... 2530138

[52] U.S. Cl. ..... 68/5 R; 34/115; 34/118

[51] Int. Cl.[2] ..... D06B 5/08

[58] Field of Search ..... 68/5 B, 5 R, 5 D, 5 E, 68/8; 8/149.3; 34/111, 123, 115–118

[56] References Cited

UNITED STATES PATENTS

| | | | |
|---|---|---|---|
| 3,110,612 | 11/1963 | Gottwald et al. | 34/116 X |
| 3,281,952 | 11/1966 | Mullaney | 34/116 X |
| 3,354,035 | 11/1967 | Gottwald et al. | 34/111 X |

FOREIGN PATENTS OR APPLICATIONS

| | | | |
|---|---|---|---|
| 749,084 | 5/1956 | United Kingdom | 8/149.3 |
| 33,037 | 8/1972 | Japan | 68/5 B |

*Primary Examiner*—Philip R. Coe
*Attorney, Agent, or Firm*—Mason, Mason & Albright

[57] ABSTRACT

Decatizing apparatus comprises a steaming cylinder and a suction cylinder. Respective primary backing cloths are associated with the steaming and suction cylinders to press the fabric to be treated against the cylinders, the tension of each primary backing cloth being adjustable independently of the other backing cloth. An intermediate backing cloth is interposed between each primary backing cloth and the fabric in the zone of the cylinder, and moves over the cylinder with its associated primary backing cloth without slipping. The intermediate backing cloths permit the use of high surface pressures to be applied by the primary backing cloths.

16 Claims, 2 Drawing Figures

DECATIZING OF FABRICS

BACKGROUND OF THE INVENTION

1. Field of the Invention

The present invention relates to the decatizing of fabrics.

2. Description of the Prior Art

There is disclosed in my U.S. Pat. No. 3,885,262 a method of, and apparatus for, continuously decatizing woven fabrics, knitted fabrics and other fabrics, using at least one steam cylinder and one suction cylinder, over each of which a respective endless pre-tensioned backing cloth is guided and which presses the fabric against the associated cylinder, the tensions in the parts of the backing cloths extending around the cylinders being variable independently of one another.

This method and apparatus provide good decatizing effects and also useful shrinking effects.

With certain fabrics it is preferred to provide only a relatively low surface pressure during steaming, and a relatively high surface pressure during the suction treatment. However, with other fabrics it has been found more advantageous to make the surface pressure during steaming substantially higher than during the suction treatment. To obtain the required surface pressure, the backing cloths are used as pressure bands and, by being tensioned in the longitudinal direction, exert a radial pressure on the fabric in the region of the respective cylinder, independent of the pressure at the other cylinder.

It has been found that when the surface pressure is significantly increased a better and more noticeable decatizing effect can be produced. It has also been found that the intensity of the decatizing effect is primarily dependent on the magnitude of the surface pressure during the treatment.

However, there are limits to the possible increase of these decatizing effects. With the method and apparatus disclosed in the aforesaid U.S. patent, conventional finishdecatizing effects and also slight lustre decatizing effects can be achieved without difficulty. But if it is desired to increase the effect further to provide lustre decatizing and boiler decatizing, difficulties do arise.

These difficulties arise due to the fact that with high surface pressures, for instance above 0.4 kg/cm$^2$, the surface of the backing cloth acting as a pressure ban tends to mark the decatized material, and also, since the tension required to produce surface pressures of this magnitude is relatively high, the backing cloth must consist of a very strong material. Since a certain air-permeability is also required, a relatively non-uniform surface structure is formed and irregularities on the surface and differences in smoothness and density cause the fabric to be marked during decatizing.

SUMMARY OF THE INVENTION

According to the invention, there is provided in apparatus for the continuous decatizing of a fabric, at least one steaming cylinder, at least one suction cylinder, means for feeding the fabric around the cylinders, a first length of primary backing cloth extending around the steaming cylinder to press the fabric against the cylinder, a second length of primary backing cloth extending around the suction cylinder to press the fabric against the cylinder, means for varying the tension in each of said lengths independently of the tension in the other said length, a first seamless, endless, intermediate backing cloth located between the first said length of backing cloth and the fabric, and a second seamless, endless, intermediate backing cloth arranged between the second said length of backing cloth and the fabric, said intermediate backing cloths moving with their associated lengths of backing cloths in the zone of the cylinders without slipping.

These intermediate backing cloths preferably consist of very fine satin fabric or the like and permit decatizing without marking the fabric.

Since the intermediate backing cloths are pressed against the fabric being decatized, a satisfactory drive free from slip is obtained. A high degree of tensioning for the intermediate backing cloths is therefore not necessary. The intermediate backing cloths need only be tensioned to a degree sufficiently to ensure their movement without folding. The low tension in the intermediate backing cloths permits an increased working life.

The intermediate backing cloths travel together with the primary backing cloths and without slip only around the cylinders, but elsewhere the intermediate backing cloths are each separated from their associated primary backing cloth so that outside the zone of the cylinders, the paths of the intermediate backing cloths deviate from those of the primary backing cloths.

The primary backing cloths are preferably tensioned by means of tensioning rollers, whereby the contact pressure force and therefore the surface pressure can be adapted to the kinds of fabric to be treated.

The primary backing cloths preferably consist of very strong air-permeable material, preferably of synthetic felt with or without inlay materials or filling materials.

Preferably, the surface of each cylinder is covered by a multi-layer sleeve consisting of seamless cotton-satin fabric tubes and/or of round-knitted synthetic tubes. These sleeves are shrunk on to the cylinders in a known manner, so that a firm anchorage is ensured. The sleeves are free from markings and facilitate uniform supply of steam or air, through the primary backing cloths, the intermediate backing cloths, and the fabric, into the interior of the respective working cylinder. Advantageously, the synthetic tubes are shrunk onto the cylinders, and then the satin tubes are shrunk onto the cylinders, whereby the satin tubes will be in contact with the material; this is preferred since the surface of the satin tubes is substantially finer and more homogeneous than that of the synthetic tubes.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENT

Figure 1:
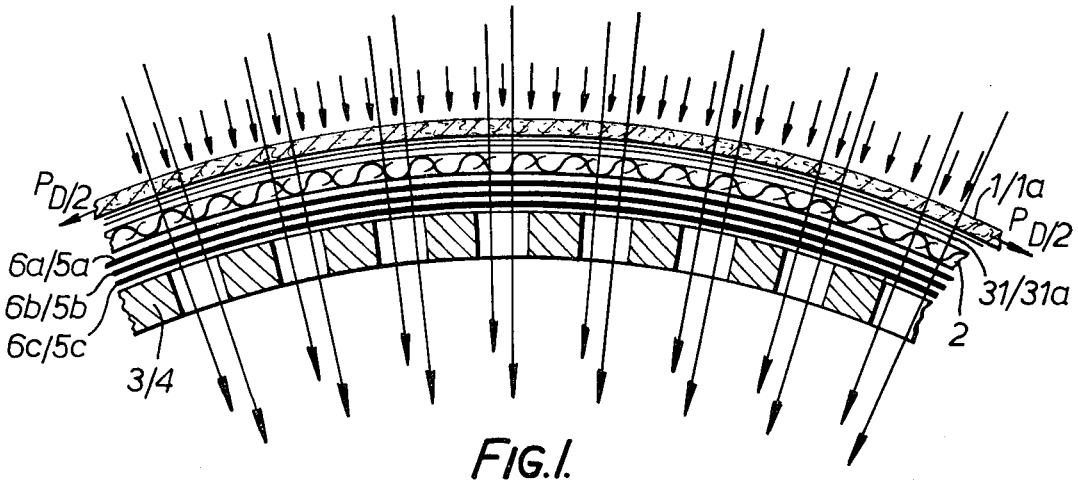
FIG. 1 is a vertical section through part of a decatizing cylinder of decatizing apparatus in accordance with the invention.
Figure 2:
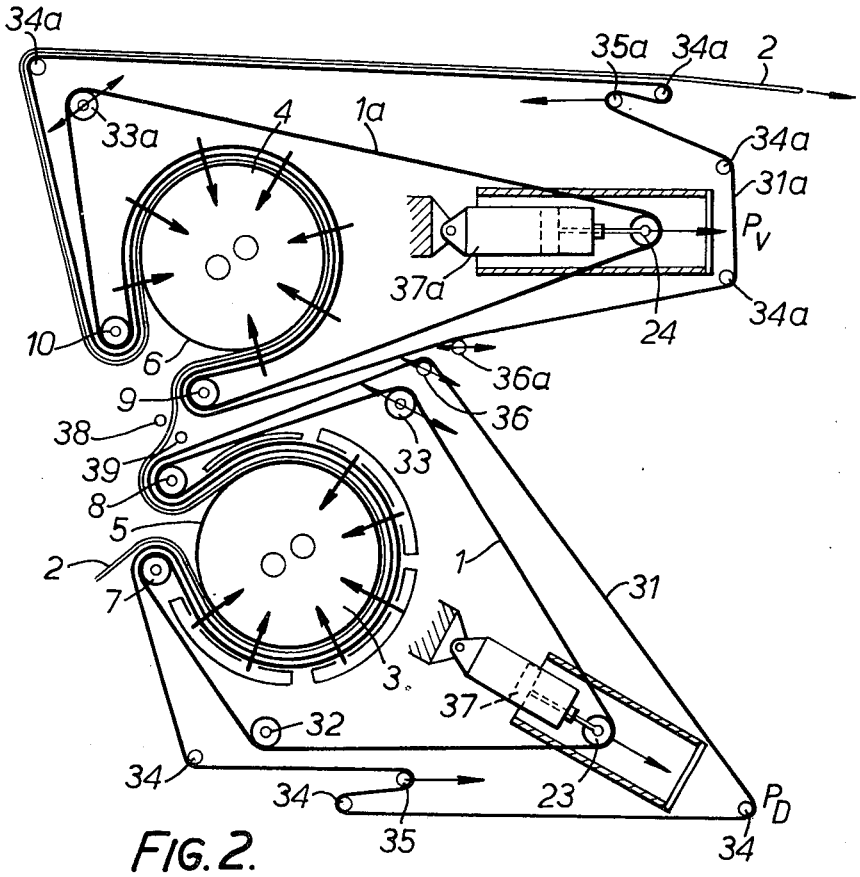
FIG. 2 is a schematic vertical section through the decatizing apparatus.

In the drawings 1, 1*a* denote respective endless primary backing cloths which serve as pressure bands, and which consists of an endless felt and of synthetic material and the like. The backing cloths 1, 1*a* are used primarly for subjecting the fabric 2 to be treated, to the required surface pressure in the region of decatizing cylinders 3 and 4, respectively. The cylinder 3 is a steaming cylinder and the cylinder 4 is a suction cylinder. The apparatus operates in a generally similar manner to that described in my U.S. Pat. No. 3,885,262, the subject matter of which is incorporated herein by reference.

A respective feed roller 7, 9 and withdrawal roller 8, 10 is provided for each cylinder 3, 4, and the backing cloth 1, 1*a* and an intermediate backing cloth 31, 31*a* pass over these rollers.

The backing cloth 1, is guided over deflecting rollers 32, 33 and 23 and the backing cloth 1*a* is guided over deflecting rollers 33*a* and 24. The deflecting rollers 23 and 24 of the backing cloths 1 and 1*a*, respectively, are tensioning rollers which are connected to fluid-actuated tensioning cylinders 37 and 37*a*, respectively. The tensioning rollers 23 and 24 and their supports are so dimensioned that surface pressure values of the order of magnitude of 0.4 kg/cm² to 2.0 kg/cm² can be produced in the region of the two cylinders 3, 4. By stepless variation of the fluid pressure in the tensioning cylinders 37 and 37*a*, it is thus possible to preselect any required surface pressure in the region of the cylinders 3, 4. By this means the peripheral speeds of the backing cloths 1 and 1*a* can be changed and adjusted.

The backing cloths 1 and 1*a* are driven by means of their associated withdrawal rollers 8 and 10. The withdrawal roller 10 is provided with a variable drive which can be accurately adjusted.

The deflecting roller 32 and the feed rollers 7 and 9 are freely rotatable without any drive of their own. This also applies to the cylinders 3 and 4.

The backing cloths 1 and 1*a* preferably consist of felt material reinforced with internal filling materials, for instance needled polyester/polyamide webs.

The intermediate backing cloths 31, 31*a* are located between the backing cloths 1, 1*a* and the fabric 2 to be treated; in the region of the pressure zone they travel with backing cloths 1, 1*a* over the withdrawal rollers 8, 10 without slipping, and bear against the fabric 2 during the decatizing process. The intermediate backing cloths 31, 31*a* are seamless and endless and consist, for example, of cotton or cotton/polyamide satin fabric or the like with a very fine surface structure.

The intermediate backing cloths 31, 31*a* are guided over deflecting rollers 34, 35, 36 and 34*a*, 35*a*, 36*a*, respectively. The deflecting rollers 33, 33*a* of the backing cloths 1, 1*a* and the deflecting rollers 36, 36*a* of the intermediate backing cloths 31, 31*a* are control rollers which are movable to maintain the associated backing cloth on its correct path. On the other hand, the deflecting rollers 35, 35*a* of the intermediate backing cloths 31, 31*a* are tensioning rollers which tension the intermediate backing cloths 31, 31*a* only slightly. A tension which is enough to ensure movement of the intermediate backing cloths without folding is sufficient. The tensioning force of the intermediate backing cloths 31, 31*a* in the longitudinal direction is thus not affected by the variable tensioning force of the backing cloths 1, 1*a*; only the surface pressure of the backing cloths 1, 1*a*, resulting from the tensioning forces $P_D/P_V$, is transmitted by the intermediate backing cloths 31, 31*a* to the fabric 2 which is to be treated.

The cylinders 3, 4 have on their periphery a wrapping in the form of a shrunk-on sleeve 5, 6 respectively, of felt with a fine surface structure or other suitable material. As shown in FIG. 1 a plurality of tubes 5*a*, 5*b*, 5*c* or 6*a*, 6*b*, 6*c* of cotton-satin fabric and/or round-knitted synthetic tubes, shrunk on one above the other, may be used in a multi-layer arrangement to form the sleeves 5, 6.

In operation of the decatizing apparatus, the backing cloths 1, 1*a* are driven by means of the withdrawal rollers 8, 10. In order to enable shrinkage in the fabric 2 also to take place in addition to the decatizing effect, speed regulation between the withdrawal rollers 8 and 10 is preferred. Shrinkage can occur only if movement of the fabric 2 between the steaming cylinder 3 and the suction cylinder 4 is completely free from tension. The fabric 2 is therefore loose in this zone in order to react and shrink, even under the action of air at room temperature.

For supervising the continuously loose state of the fabric 2 in the zone between the cylinders 3 and 4, sensor means 38, 39 which sense the state of the fabric without contact therewith are arranged to control and adjusting motor for the variable drive of the withdrawal roller 10. Thus, for a given speed of the withdrawal roller 8 at the steaming cylinder 3 automatic speed regulation of the withdrawal roller 10 at the suction cylinder 4 is carried out in such a manner that a loose state of the fabric 2 between the two cylinders 3 and 4 is always maintained.

In the apparatus particularly described, the use of the intermediate backing cloths permits decatizing at surface pressure of from about 0.4 kg/cm² to 2.0 kg/cm² without marking the fabric.

I claim:

1. In apparatus for the continuous decatizing of a fabric, at least one steaming cylinder, at least one suction cylinder, means for feeding the fabric around the cylinders, a first length of primary backing cloth extending under tension around the steaming cylinder to press the fabric against the cylinder, a second length of primary backing cloth extending under tension around the suction cylinder to press the fabric against the cylinder, means for varying the tension in each of said lengths independently of the tension in the other said length, a first seamless, endless, intermediate backing cloth located between the first said length of backing cloth and the fabric, and a second seamless, endless, intermediate backing cloth arranged between the second said length of backing cloth and the fabric, said intermediate backing cloths moving with their associated lengths of backing cloths in the zone of the cylinders without slipping.

2. Apparatus according to claim 1, wherein the first length of backing cloth is defined by a portion of a first endless, primary backing cloth, and the second length of backing cloth is defined by a portion of a second, endless, primary backing cloth.

3. Apparatus according to claim 2, wherein the feed means comprises a respective feed roller and withdrawal roller associated with each cylinder, the primary backing cloths and the intermediate backing cloths being guided over the feed and withdrawal rollers of their associated cylinders, said apparatus further comprising separate deflecting rollers for each of the primary and intermediate backing cloths.

4. Apparatus according to claim 3, wherein one of the deflecting rollers of each of the primary backing cloths is a tensioning roller, and the tension-varying means comprises a respective fluid actuated cylinder linked to each of the said tensioning rollers to vary the force applied by that tensioning roller.

5. Apparatus according to claim 3, wherein one of the deflecting rollers for each of said primary and intermediate backing cloths is movable to maintain the associated backing cloth on a predetermined path.

6. Apparatus according to claim 3, wherein one of the deflecting rollers for each of the intermediate backing cloths is a tensioning roller.

7. Apparatus according to claim 3, wherein the withdrawal rollers are driven rollers and act to drive the associated primary backing cloths.

8. Apparatus according to claim 7 further comprising non-contact sensor means responsive to the fabric portion between the steaming cylinder and the suction cylinder, to control the speed of the withdrawal roller of the suction cylinder so that said fabric portion is substantially free from tension.

9. Apparatus according to claim 3, wherein the feed rollers and deflecting rollers of the primary backing cloths are freely rotatable.

10. Apparatus according to claim 2, wherein the cylinders are freely rotatable.

11. Apparatus according to claim 1, wherein the primary backing cloths are composed of an air-permeable material of high strength.

12. Apparatus according to claim 11, wherein the primary backing cloths are composed of felt with an internal reinforcement.

13. Apparatus according to claim 1, wherein the intermediate backing cloths are composed of satin.

14. Apparatus according to claim 1, further comprising sleeve means enclosing the surface of each cylinder, said sleeve means comprising a plurality of tubes shrunk one upon another.

15. Apparatus according to claim 14, wherein the tubes are composed of a satin fabric.

16. Apparatus according to claim 14, wherein the tubes are composed of a knitted fabric.

* * * * *